US005273219A

United States Patent [19]

Beach, Jr. et al.

[11] Patent Number: 5,273,219

[45] Date of Patent: Dec. 28, 1993

[54] ICE DISPENSER

[75] Inventors: Sammie C. Beach, Jr., Greenville; Gary R. Peter, Rockford, both of Mich.; Larry E. Unger, Southside, Ala.

[73] Assignee: White Consolidated Industries, Inc., Cleveland, Ohio

[21] Appl. No.: 2,595

[22] Filed: Jan. 11, 1993

[51] Int. Cl.[5] ..... B02B 1/08

[52] U.S. Cl. ..... 241/65; 222/240; 241/DIG. 17

[58] Field of Search ..... 241/DIG. 17, 65, 190, 241/243, 101.1, 238, 239; 62/320; 222/240

[56] References Cited

U.S. PATENT DOCUMENTS

| | | | |
|---|---|---|---|
| 2,174,461 | 9/1939 | Fegley et al. | 241/DIG. 17 |
| 2,208,040 | 7/1940 | Moeller | 241/DIG. 17 |
| 5,037,004 | 8/1991 | Katz et al. | 222/240 |

*Primary Examiner*—Douglas D. Watts

*Attorney, Agent, or Firm*—Pearne, Gordon, McCoy & Granger

[57] ABSTRACT

An ice dispenser provides a storage bin in which ice cubes manufactured by an ice maker are stored until used. A powered agitator within the bin operates to move cubes to an exit end where they enter a lifting and metering drum. From the lifting and metering drum the ice cubes, in one embodiment, pass through an adjustable ice crusher which functions to crush the ice into particles the size of which can be changed by adjustment of the crusher. In one position, the crusher can be adjusted so that uncrushed cubes pass through the crusher. In a second embodiment, a deflector is provided to allow the ice cubes to bypass the crusher when uncrushed cubes are required. The deflector is moveable to a position to cause the cubes to pass through the crusher and for delivery of crushed ice. The lifting and metering drum operates at a lower speed than the agitator or crusher and is driven by gearing connecting the lifting and metering drum with the agitator. Similarly, the crusher is driven by gearing connecting the crusher with the agitator. Speed of the agitators is substantially greater than the speed of the lifting and metering drum.

11 Claims, 7 Drawing Sheets

ICE DISPENSER

BACKGROUND OF THE INVENTION

This invention relates generally to ice dispensers for domestic refrigerator freezers, and more particularly, to a novel and improved dispensing system operable to dispense crushed and uncrushed ice.

PRIOR ART

Typical through-the-door ice dispensing systems provide an automatic ice maker located in a freezer section of a refrigerator freezer unit. Such ice makers produce discreet pieces of ice, which are referred to herein as ice cubes, even though they may have a crescent or other shape which is not a cube shape. Such units include a storage bin which receives the ice cubes from the ice maker where the cubes are stored until used. Typically, a dispenser system is provided to deliver the cubes when required by the user.

In some such power dispensing systems, means are provided to move the cubes from the bin and deliver the uncrushed ice cubes to a glass held by the user. Examples of such systems are illustrated in the U.S. Pat. Nos. 4,084,725 and 4,942,979.

In other instances, the dispensing system includes a crusher which operates to crush the cubes and deliver the ice as finely divided ice particles. Further, in some instances, the dispenser can be selectively operated to deliver crushed ice or uncrushed cubes. Examples of such systems are illustrated in the U.S. Pat. Nos. 4,176,527; 4,627,556; 4,972,999; and 5,056,688.

Further, some dispensing units include powered agitators to move the cubes along the storage bin to the exit portion thereof. Some agitators are formed as a helical rod. Other agitators are also often formed of a rod which is provided with a planar serpentine shape, rather than a helical shape. These non-helical agitators are usually used in bins having an inclined bottom wall extending to the bin exit.

SUMMARY OF THE INVENTION

There are a number of aspects to the present invention, and in accordance with one important aspect of this invention, a dispenser provides a user adjustable ice crusher. Such crusher can be adjusted to produce various sizes of ice particles, from very finely divided small particles, to relatively coarse larger particles. Further, the unit can also be selectively operated to deliver uncrushed ice cubes. In one embodiment, the delivery of uncrushed ice cubes is accomplished by retracting one set of crusher blades so that the cubes pass through the crusher without being crushed. In another embodiment, a deflector moves between one position in which the cubes are directed to the crusher, and another position in which the cubes bypass the crusher.

In accordance with another important aspect of this invention, the unit provides an agitator, a metering and lifting drum, and a crusher. A single motor drives all three. However, the drum is driven at a substantially slower speed than the agitator and crusher. The agitator operates at a sufficiently high speed to ensure that the drum is fully loaded, and the crusher is operated at a sufficiently high speed to ensure that all of the cubes delivered thereto are properly crushed. However, the relatively slow operating speed of the drum ensures that the crusher is not overloaded or clogged.

Another important aspect of this invention involves the mounting of the bin so that it can be pulled forward and tipped down when the freezer compartment door is open and direct access to the bin is desired. Also, the motor is mounted in the fixed position, but is provided with a drive connection which allows such bin movement and is reconnected when the bin is returned to its normal position.

These and other aspects of this invention are illustrated in the accompanying drawings and are more fully described in the following specification.

DETAILED DESCRIPTION OF THE DRAWINGS

Figure 1:
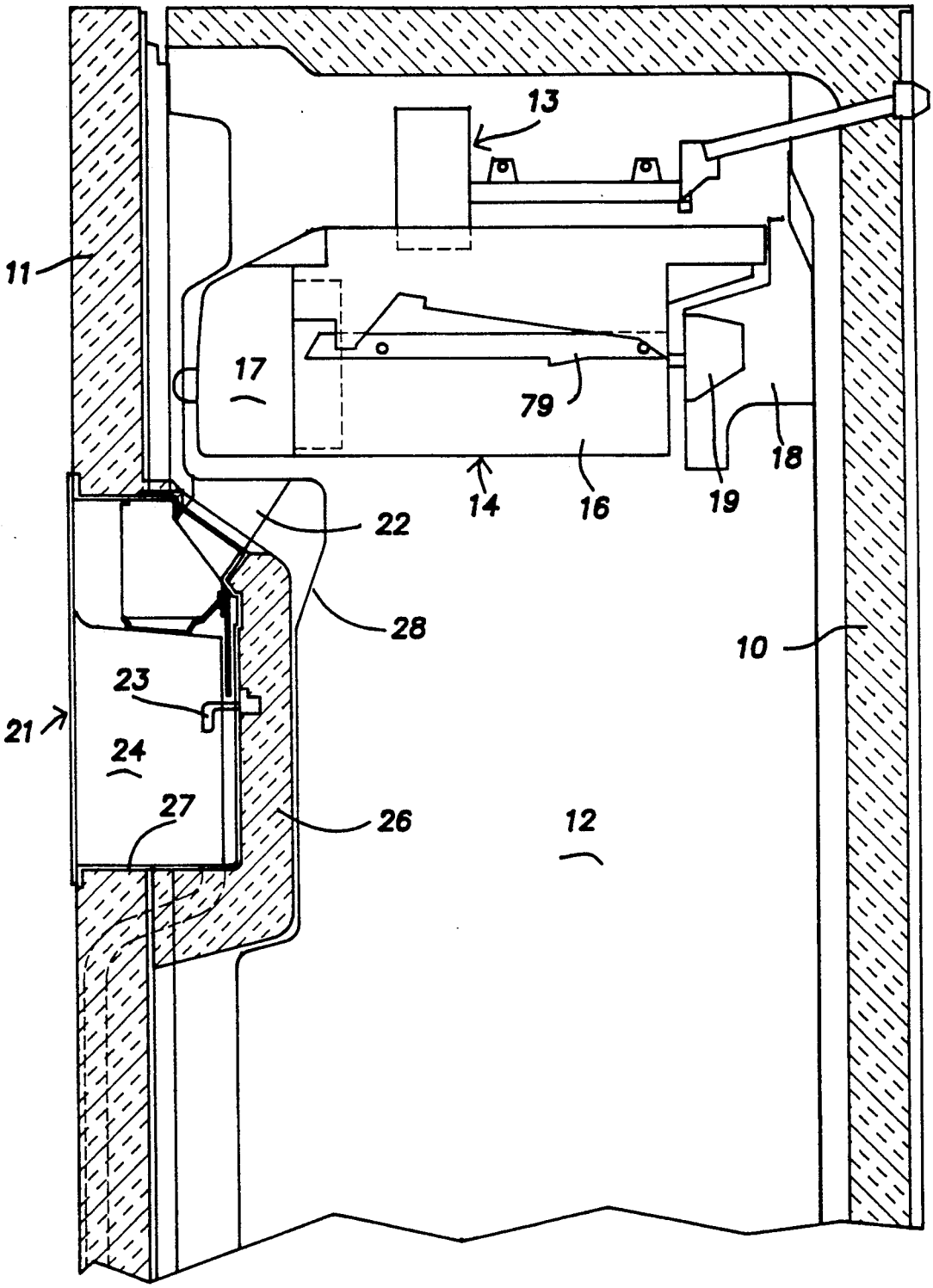
FIG. 1 is a fragmentary view partially in section illustrating the overall through-the-door ice dispensing system incorporating an ice dispenser in accordance with the present invention.

FIG. 1 illustrates a typical installation of an ice dispensing system, in accordance with the present invention, installed in a side-by-side refrigerator. It should be understood, however, that the system can also be installed in refrigerator/freezer combinations in which the freezing compartment is located above the compartment containing unfrozen food.

The unit illustrated in FIG. 1 includes a cabinet 10 having a door 11 mounted with hinges on the front of the cabinet for movement between a closed position illustrated and an open position permitting access to the interior of the freezer compartment 12. Located within the freezer compartment 12 near the upper extremity thereof is an automatic ice maker, which may be of any suitable type, such as the ice maker illustrated in the U.S. Pat. No. 5,010,738. Such patent is incorporated herein in its entirety to illustrate a typical ice maker that can be utilized in the dispensing system of the present invention.

Located immediately below the ice maker 13 is a bin and crusher assembly 14. The bin portion 16 of the assembly 14 is located below the ice maker and receives ice cubes produced by the ice maker 13 and stores such cubes until they are to be used. A powered ice crusher 17 is located at the forward end of the bin and crusher assembly, as described in detail below. Located behind the bin and crusher assembly 14 is a drive unit 18 which is mounted on the rearward wall of the cabinet 10.

The actual dispensing unit 21 is mounted in the door 11 and is positioned below the ice crusher 17 when the door is closed. A chute 22 extends between the ice crusher and the dispensing unit 21 and directs the cubes, or crushed ice as the case may be, into the receptacle, usually a glass, held by the user against a dispensing actuator 23.

In the illustrated embodiment, the dispensing unit 21 provides a recess 24 which is located in a pocket-like structure molded into the foam insulation 26. The recess is formed during the molding operation by a mold insert 27 sized and shaped to receive the dispensing unit 21.

An inner liner 28 encloses the rearward side of the insulation and provides a portion of the chute 22. The dispensing unit 21 and the manner in which it is mounted within the door and functions is the subject matter of the co-pending application Ser. No. 07/969,995, filed Nov. 2, 1992. Reference to such application will provide a detailed description of the structure and mode of operation of the dispensing unit itself.

Figure 2:
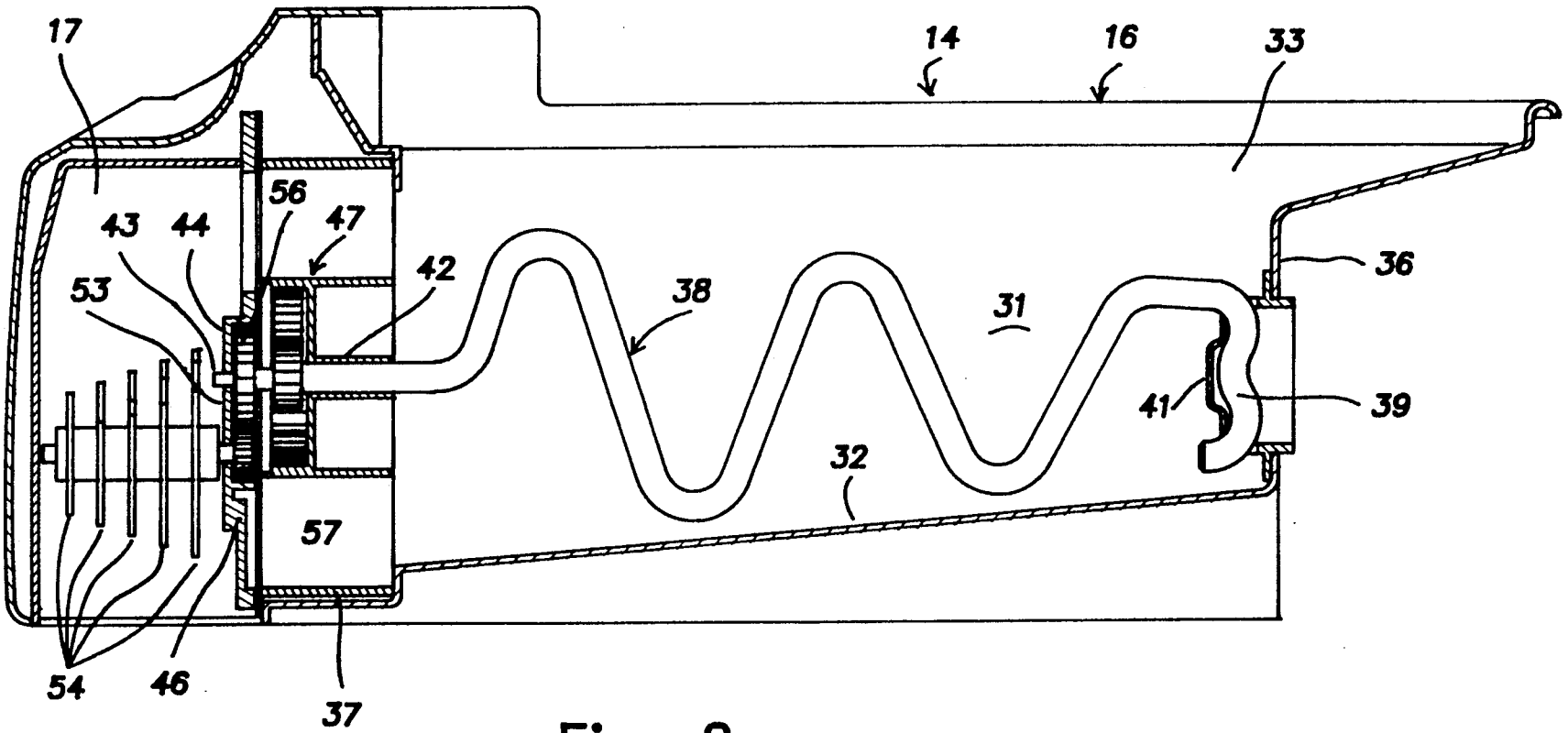
FIG. 2 is a longitudinal section of an ice dispenser and crusher in accordance with the present invention illustrating the principle component parts thereof.
Figure 3:
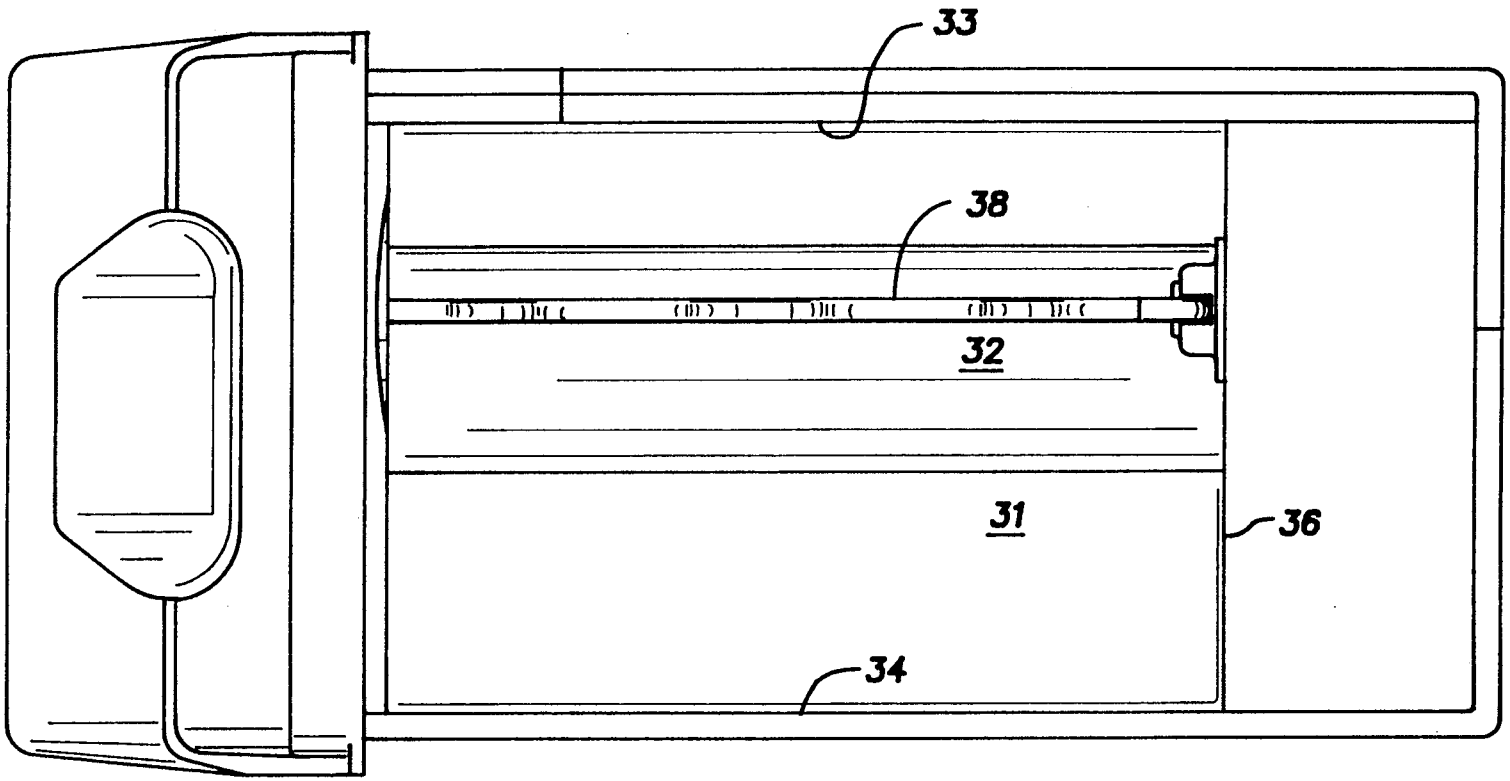
FIG. 3 is a plan view of the dispenser illustrated in FIG. 2.

FIG. 2 illustrates the bin and crusher assembly 14 in longitudinal section. The bin portion 16 is preferably molded of a rigid plastic and provides an elongated storage zone 31 having an inclined bottom wall 32 and opposed converging inclined sidewalls 33 and 34. The sidewalls 33 and 34 are inclined inwardly and cooperate with the bottom wall 32 to form a trough-like, smoothly curved storage zone in which ice cubes (not illustrated) are stored until they are dispensed, as described in more detail below.

A rearward wall 36 closes the rearward end of the storage zone 31, and a lifting and metering drum 37 is journaled at the exit or forward end of the storage zone 31.

A serpentine-shaped agitator 38 provides a rearward end 39 mounted in a bearing cap 41 in the rearward wall 36. The forward end of the agitator 38 extends with a close fit through a tubular portion 42 molded into the lifting and metering drum 37 and is journaled at its forward end 43 within a bearing 44 supported within a forward end wall 46. Therefore, the forward end of the agitator 38 functions to support the lifting and metering drum 37 within the unit, as described in greater detail below.

Figure 7:
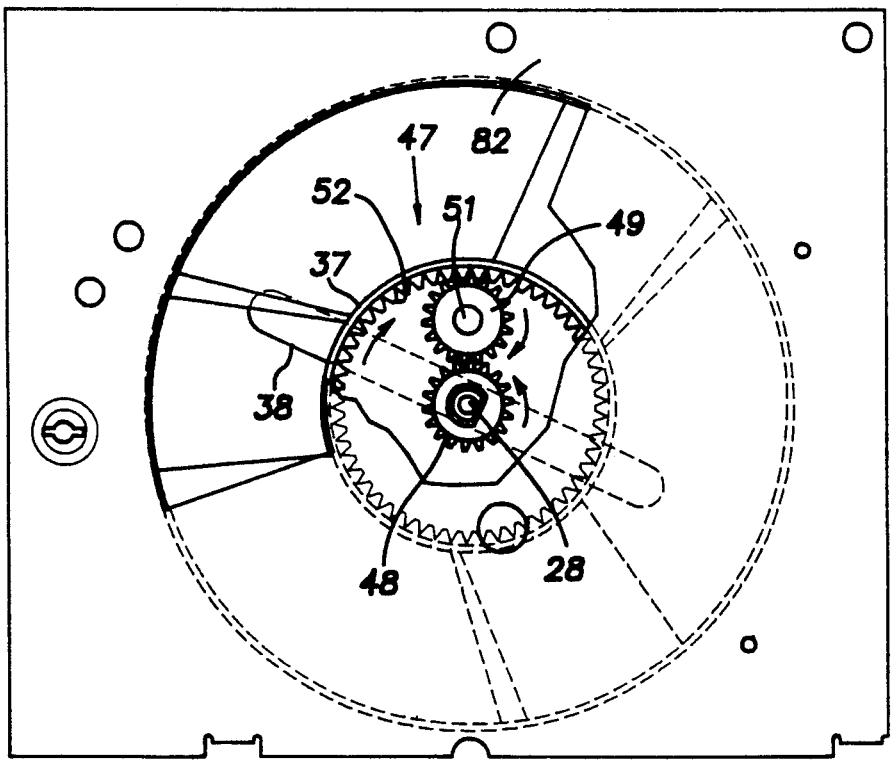
FIG. 7 is a fragmentary view illustrating a planetary drive which interconnects the agitator and lifting and metering drum while reducing the speed of such drum.

A planetary gearing system 47 connects the agitator 38 and the lifting and metering drum 37. The structure of this gearing system 47 is best illustrated in FIG. 7. The gearing system includes a sun gear 48 mounted on the agitator 38 for rotation therewith. The sun gear 48 meshes with a planet or idler gear 49 journaled on a fixed pivot shaft 51 and also meshes with an interior ring gear 52 formed on the lifting and metering drum 37. In the illustrated embodiment, the gearing system 47 provides a three-to-one gear reduction so that the lifting and metering drum 37 rotates through one complete revolution each time the agitator 38 rotates through three complete revolutions. Further, with this gearing system, the direction of rotation of the lifting and metering drum 37 is opposite the direction of rotation of the agitator 38.

In the illustrated embodiment, the agitator 38 is formed with reverse bends and extends along a single plane rather than a helix. This structure, in combination with the inclined bottom wall 38 ensures that ice cubes contained within the storage zone move to the exit end of the storage zone where the lifting and metering drum 37 is located. It is preferable to form the agitator with relatively sharp bends so that the likelihood of an ice cube being jammed between one of the bin's walls is substantially eliminated.

Beyond the planetary gear system 47 is a secondary gearing 53 which provides a driving connection between the agitator 38 and the rotating blades 54 of the ice crusher. This gearing system includes a drive gear 56 mounted on the adjacent end of the agitator 38 for rotation therewith and a driven gear 57 mounted on the inner end of the rotating crusher blade support shaft 55. In this illustrated embodiment, the drive gear 56 is slightly larger than the driven gear 57 so that the support shaft 55 rotates at a speed slightly greater than the speed of rotation of the agitator and at a speed substantially greater than the speed of rotation of the lifting and metering drum 37.

In the illustrated embodiment, there are five powered rotating crusher blades 54 mounted at spaced locations along the support shaft 55. Each of the rotating crusher blades 54 has a shape generally similar to the other of such blades and includes crusher points 59 which cooperate with non-rotating blades 58 to penetrate into the ice cubes and function to crush the cubes into relatively small pieces. These blades, however, are mounted on the support shaft in progressive positions best illustrated in FIG. 8 so that the individual rotating blades sequentially engage the ice cubes to be crushed.

Figure 8:
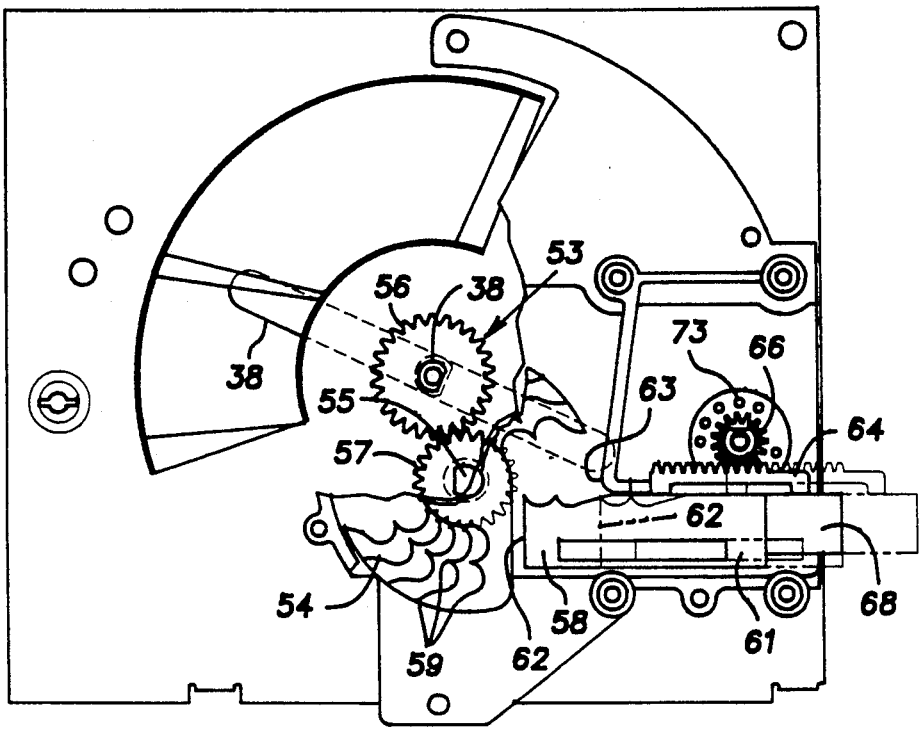
FIG. 8 is a fragmentary view illustrating the crusher drive and the adjustment of the crusher to change the size of the particles of crushed ice produced.

The non-rotating blades 58 are cast on a single member 61 and are moveable laterally from an inner position, illustrated in FIG. 8, to a retracted position, illustrated in phantom, in which the ends 62 are substantially aligned with a guide wall 63.

Figure 9:
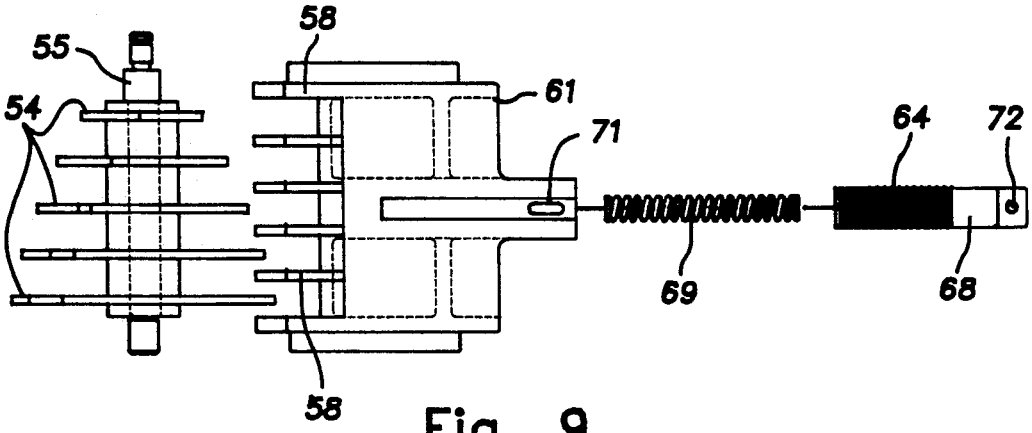
FIG. 9 is an exploded plan view illustrating the crusher structure and the mechanism for adjusting the crusher.

As best illustrated in FIG. 9, there are six non-rotating blades 58 which interleave with the five rotating blades 54. When the non-rotating blades are in the extended position illustrated in FIG. 8, ice cubes carried by the rotating blades engage the non-rotating blades and are crushed to fine particle sizes. As the non-rotating blades 58 are moved progressively toward the retracted position, the overlap or interleaving is reduced, and the size of the particles of crushed ice produced is increased. When the non-rotating blades are fully retracted, they do not interleave with the rotating blades, and the ice cubes pass through the crusher without being crushed and are delivered as full-sized ice cubes.

Figure 4:
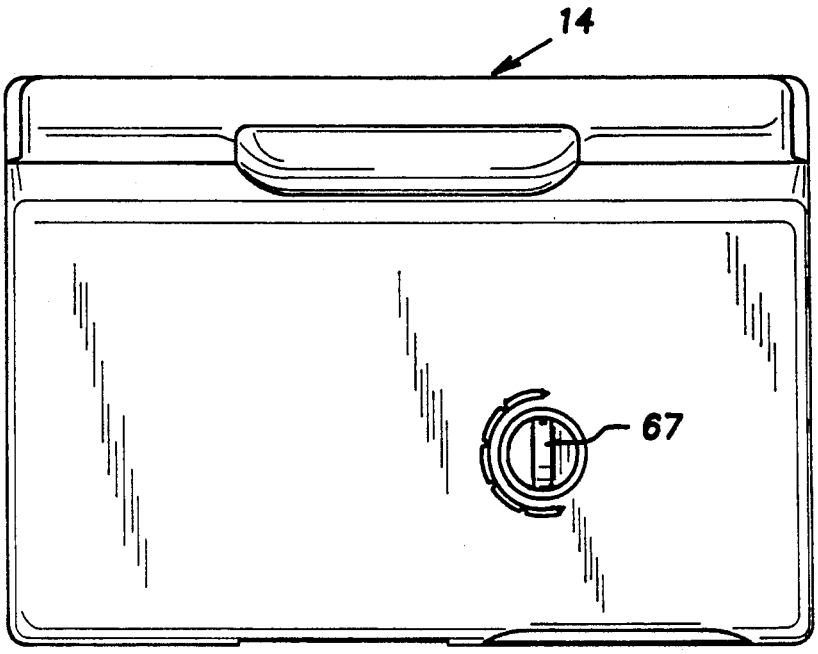
FIG. 4 is an end view of the dispenser illustrating the knob which operates to adjust the ice crusher.

The position of the casting 61, and in turn, the non-rotating crusher blades 58, is determined by an adjusting rack 64 and pinion 66. The pinion 66 is on a shaft connected to an adjusting knob 67 (best illustrated in FIG. 4) so that the user can establish the size of the crushed ice to be delivered by the unit.

As best illustrated in the exploded view of FIG. 9, the rack is formed on a casting 68 which fits into the outer end of the casting 61 with a compression spring 69 received within a bore formed in the casting 68. With this structure, movement of the casting 68 to the left, as viewed in FIG. 8, causes corresponding movement to the left of the casting 61 to increase the depth of interleaving between the stationary and rotating blades. However, if a blocking ice cube is located in a position preventing such movement, the spring 69 is compressed, allowing the adjustment of the casting 68, even though corresponding movement of the casting 61 does not occur. As soon as the dispenser commences to operate, however, the blocking cube is pushed out of the way, and the non-rotating blades extend under the force of the spring 69 to the adjusted position. A roll pin 72 mounted at the rearward end of the casting 68 extends into a slot 71 formed in the casting 61 to limit the extending movement of the stationary blades with respect to the casting 68 and cooperates with the spring to normally determine the position of the casting 68 and the non-rotating blades with respect to the adjusted position of the casting 68. Since the roll pin 72 is located in the slot, however, relative movement of the adjusting casting 68 relative to the non-rotating blades 59 is permitted in the event that an ice cube blocks extending movement of the non-rotating blades.

The pinion gear 66 is formed with a flange having a plurality of detent openings 73 which receive spring-biased detent balls (not illustrated) to hold the pinion in its adjusted position while allowing user adjustment by rotating the knob 67.

Figure 5:
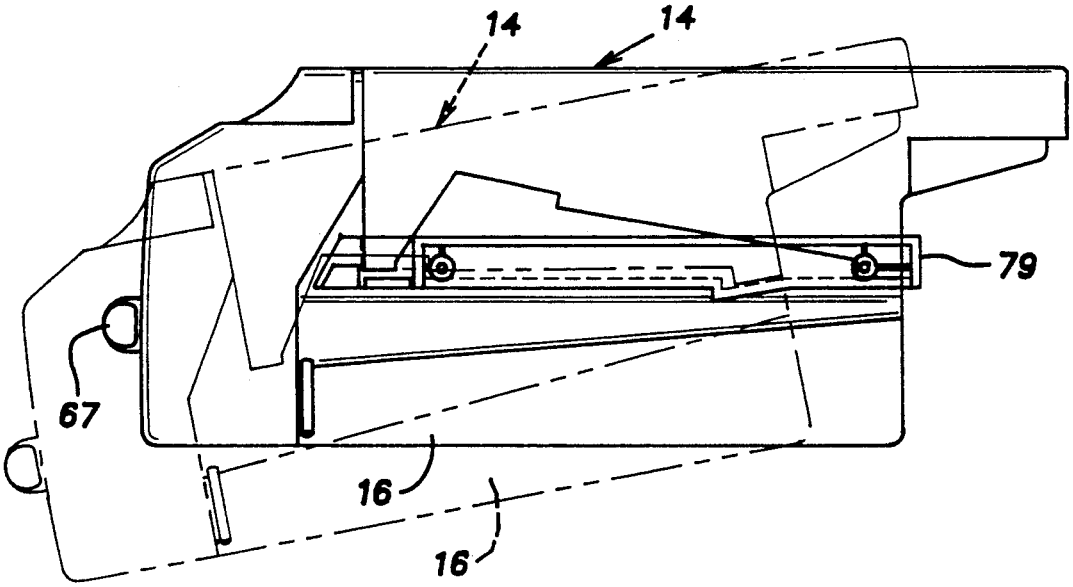
FIG. 5 is a side elevation of the ice dispenser showing the dispenser in its normal position in full line and in phantom line illustrating the dispenser in a position in which manual access to the ice cube bin is available.
Figure 6:
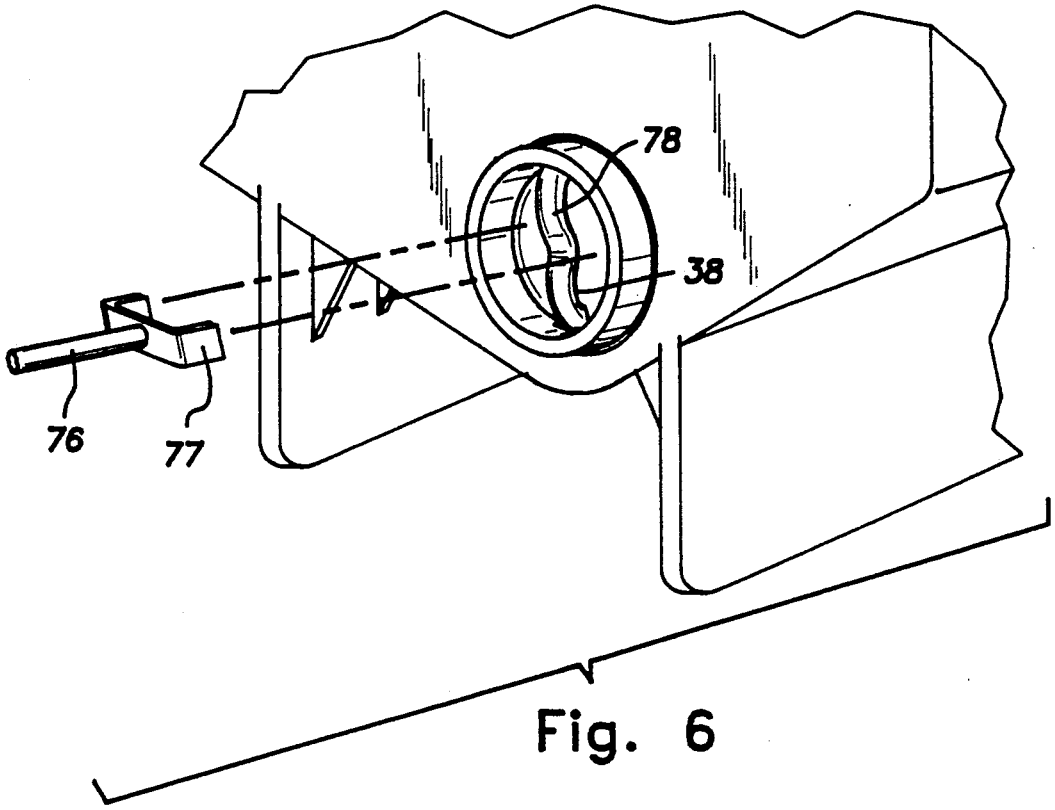
FIG. 6 is a fragmentary exploded and perspective view illustrating the structure of the drive connection between the motor and the agitator.

As best illustrated in FIG. 6, the coupling between the output shaft 76 of the drive motor 19 (illustrated in FIG. 1) is provided with a U-shaped releasable coupling 77 which embraces a lateral portion 78 on the agitator 38 when the bin and crusher assembly is in the normal position illustrated in full line in FIG. 5. However, the bin and crusher assembly can be moved forward and downward while the freezer door 11 is open to allow direct manual access to the ice cubes located within the bin portion 16. The bin and crusher assembly is mounted on side tracks 79, allowing such forward and downwardly projecting movement. However, before the door can be closed, the bin and crusher assembly 14 must be moved back along the guide tracks 79 to the full line normal operating position. In such position, the motor drive is reconnected since the U-shaped drive connection again embraces the lateral portion 78 of the agitator 38.

In a first embodiment illustrated in FIG. 8, a deflector is positioned to direct all of the ice cubes into the crusher from the lifting and metering drum. As discussed above, the crusher can be adjusted to deliver either full cubes when the non-rotating blades 58 are fully retracted, or deliver crushed ice having a size determined by the adjusted position of the non-rotating blades 58 with respect to the rotating blades 54.

Figure 10:
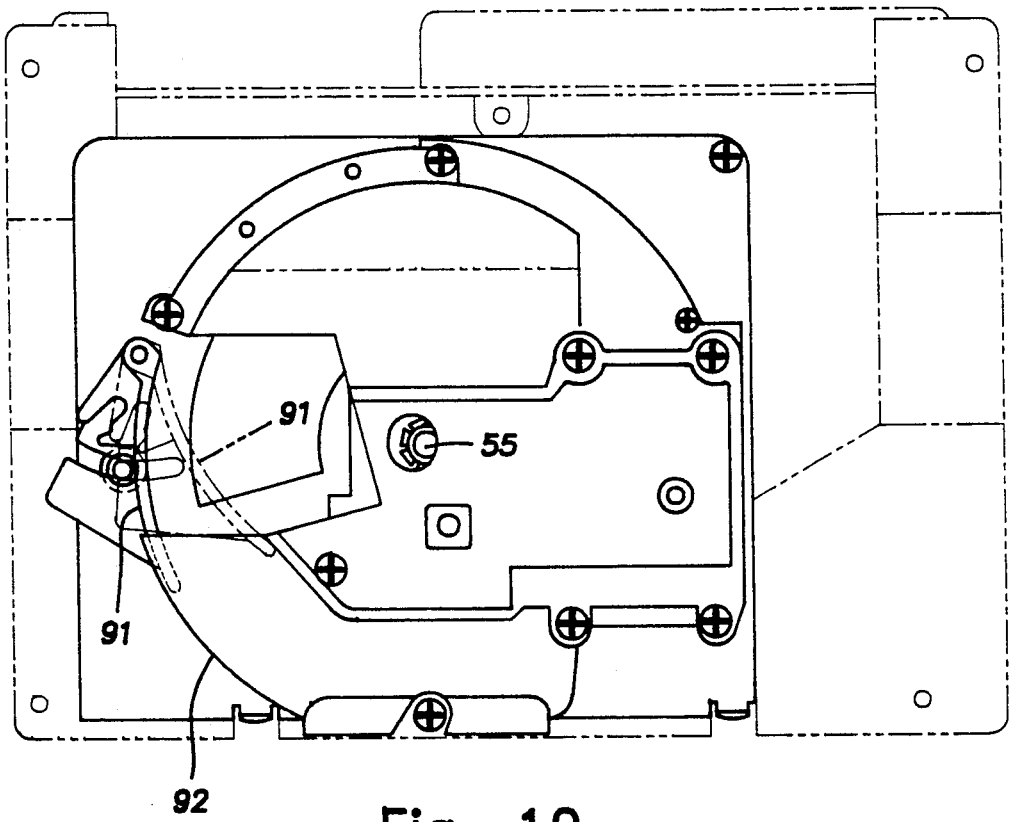
FIG. 10 is a view similar to FIG. 8, but illustrating an embodiment in which a deflector is moveable to allow ice cubes to fully bypass the crusher assembly.

In the embodiment of FIG. 10, however, a deflector 91 is moveable between a full line position in which the ice cubes bypass the crusher along a passageway 92 and directly enter the chute 22. The deflector is also moveable to a phantom line position in which the ice cubes are directed to pass through the crusher. Therefore, in this embodiment, a control (not illustrated) is provided to select the position of the deflector 81 between the bypass position, illustrated in full line, and the crushing position, illustrated in phantom.

The lifting and metering drum is formed with inclined vanes surrounding the internal ring gear which engage the cubes at the exit end of the drum and transport them upwardly through an opening 82, illustrated in FIG. 7, through which they pass into the crusher, or are allowed to bypass the crusher in the embodiment of FIG. 10. Such lifting and metering drum is generally similar to the drum illustrated in the U.S. Pat. No. 4,972,999, incorporated herein by reference. In this instance, however, the lifting and metering drum is rotated at a relatively slow speed compared to the rotational speed of the crusher and the agitator so that the crusher cannot be overloaded and will reliably produce the crushed ice cubes when crushed ice cubes are required.

Although the preferred embodiments of this invention have been shown and described, it should be understood that various modifications and rearrangements of the parts may be resorted to without departing from the scope of the invention as disclosed and claimed herein.

What is claimed is:

1. An ice dispenser comprising a bin for storing ice cubes and having an exit, powered rotatable agitator means operable to cause movement of said ice cubes to said exit, a powered crusher, a transfer drum at said exit operable to receive ice cubes at said exit and deliver such ice cubes to said crusher, first drive means connecting said agitator and drum causing rotation of said drum at a speed substantially slower than the speed of rotation of said agitator to prevent overloading of said crusher, and second drive means connected to said crusher operating to rotate said crusher at a speed substantially greater than the speed of rotation of said drum.

2. An ice dispenser as set forth in claim 1, wherein said drum rotates in a direction opposite to the direction of rotation of said agitator.

3. An ice dispenser as set forth in claim 1, wherein said second drive means connects said agitator and crusher.

4. An ice dispenser as set forth in claim 1, wherein a motor is mounted in a fixed position and third drive means connects said motor and agitator, said motor also powering said drum and crusher.

5. An ice dispenser as set forth in claim 4, wherein said bin along with said drum and crusher are moveable from a normal position to an access position providing direct user access to ice cubes in said bin, movement of said bin to said access position disconnecting said third drive means, return of said bin to said normal position reconnecting said third drive means.

6. An ice dispenser as set forth in claim 1, wherein said crusher is selectively operable to deliver uncrushed ice cubes and crushed ice.

7. An ice dispenser as set forth in claim 6, wherein said crusher includes user controlled deflector means to cause cubes to bypass said crusher when uncrushed cubes are required.

8. An ice dispenser as set forth in claim 6, wherein said crusher includes adjustable crusher blades permitting adjustment of said crusher to change the size of crushed ice particles.

9. An ice dispenser as set forth in claim 6, wherein said adjustable crusher blades are adjustable to a position allowing uncrushed cubes to pass through said crusher.

10. An ice dispenser including a crusher for crushing ice cubes comprising powered rotating laterally spaced crusher blades, non-rotatable crusher blades interleaved with said powered blades, adjusting means for moving said non-rotating blades toward and away from said powered blades to adjust the distance of interleaving of said blades and thereby adjust the size of ice particles produced by crushing ice cubes supplied to said crusher, a user operated device connected to adjust the position of said non-rotatable blades, and resilient means connecting said user operated device to said non-rotatable blades to allow movement of said user operated device to a desired adjusted position without corresponding movement of said non-rotatable blades in the event said non-rotatable blades are held against movement by a blocking ice cube, operation of said crusher clearing said blocking cube permitting said resilient means to move said non-rotating means to its adjusted position.

11. An ice dispenser as set forth in claim 10, wherein said crusher includes user controlled means to cause cubes to bypass said crusher when uncrushed cubes are required and to cause cubes to pass through said crusher when crushed ice is required.

* * * * *